US011623808B2

(12) United States Patent
Bellamah et al.

(10) Patent No.: US 11,623,808 B2
(45) Date of Patent: Apr. 11, 2023

(54) RE-SEAL LABEL AND CONTAINER WITH RE-SEAL LABEL

(71) Applicant: Altria Client Services LLC, Richmond, VA (US)

(72) Inventors: Stephen Bellamah, Richmond, VA (US); Scott A. Fath, Henrico, VA (US); Andrew Peeler, Richmond, VA (US)

(73) Assignee: Altria Client Services LLC, Richmond, VA (US)

( * ) Notice: Subject to any disclaimer, the term of this patent is extended or adjusted under 35 U.S.C. 154(b) by 0 days.

(21) Appl. No.: 17/872,090

(22) Filed: Jul. 25, 2022

(65) Prior Publication Data

US 2022/0355994 A1 Nov. 10, 2022

Related U.S. Application Data

(63) Continuation of application No. 16/875,044, filed on May 15, 2020, now Pat. No. 11,414,251, which is a (Continued)

(51) Int. Cl.
*B65D 85/10* (2006.01)
*B65D 75/58* (2006.01)
(Continued)

(52) U.S. Cl.
CPC ..... *B65D 75/5894* (2013.01); *B65D 5/66* (2013.01); *B65D 65/14* (2013.01);
(Continued)

(58) Field of Classification Search
CPC ..... B65D 75/5838; B65D 5/66; B65D 65/14; B65D 85/1027; B65D 85/1045; A24F 15/00
(Continued)

(56) References Cited

U.S. PATENT DOCUMENTS 3,727,828 A 4/1973 Hall
3,996,945 A 12/1976 McDowell
(Continued)

FOREIGN PATENT DOCUMENTS

EP 0873858 A1 10/1998
EP 3009374 A1 4/2016
(Continued)

OTHER PUBLICATIONS

Extended European Search Report dated Apr. 12, 2018 in corresponding European Patent Application No. 17196271.5-1016 (9 pages).
(Continued)

*Primary Examiner* — Jacob K Ackun
(74) *Attorney, Agent, or Firm* — Harness, Dickey & Pierce, P.L.C.

(57) ABSTRACT

In an example embodiment, a re-sealable label for covering an opening of a box includes a sheet of polymer material that includes a re-sealable adhesive on an underside thereof. A liner is adhered to the underside of the sheet of polymer material. The liner is configured to cover the opening and includes a foil layer and a paper layer. The sheet of polymer material includes a line of perforations wherein one or more of the perforations of the line of perforations include a rectilinear portion and a non-rectilinear portion.

20 Claims, 3 Drawing Sheets

Related U.S. Application Data continuation of application No. 16/568,734, filed on Sep. 12, 2019, now Pat. No. 10,689,176, which is a continuation of application No. 16/193,112, filed on Nov. 16, 2018, now Pat. No. 10,450,120.

(51) Int. Cl.
*B65D 65/14* (2006.01)
*B65D 5/66* (2006.01)

(52) U.S. Cl.
CPC ..... *B65D 75/5838* (2013.01); *B65D 85/1027* (2013.01); *B65D 85/10568* (2020.05)

(58) Field of Classification Search
USPC ..... 206/268; 229/87.05
See application file for complete search history.

(56) References Cited

U.S. PATENT DOCUMENTS 4,293,068 A 10/1981 Focke et al.
4,300,676 A 11/1981 Focke et al.
4,375,260 A 3/1983 Focke et al.
4,555,027 A 11/1985 Froom
4,607,748 A 8/1986 Focke
4,712,689 A 12/1987 Froom
4,763,779 A 8/1988 Focke et al.
4,771,882 A 9/1988 Lowe et al.
4,942,961 A 7/1990 Focke et al.
5,018,625 A 5/1991 Focke et al.
5,022,950 A 6/1991 Ingalls et al.
5,080,227 A 1/1992 Focke
5,096,113 A 3/1992 Focke
5,158,664 A 10/1992 Colgan
5,788,065 A 8/1998 Focke
5,914,165 A 6/1999 Freedman
5,924,573 A 7/1999 Piraneo et al.
6,000,539 A 12/1999 Stewart-Cox et al.
6,026,953 A 2/2000 Nakamura et al.
6,132,349 A 10/2000 Yokoyama
6,164,444 A 12/2000 Bray
6,237,760 B1 5/2001 Parker et al.
6,309,105 B1 10/2001 Palumbo
6,478,149 B1 11/2002 Parker
6,481,259 B1 11/2002 Durney
6,505,735 B1 1/2003 Parker
6,606,840 B2 8/2003 Focke et al.
6,736,262 B2 5/2004 Focke
6,874,623 B2 4/2005 Bray
6,877,349 B2 4/2005 Durney et al.
6,974,406 B2 12/2005 Antonacci
7,350,688 B2 4/2008 Sierra-Gomez et al.
7,533,773 B2 5/2009 Aldridge
7,703,602 B2 4/2010 Saito et al.
7,789,291 B2 9/2010 Andersson et al.
7,827,769 B2 11/2010 Bertuzzi
7,862,869 B2 1/2011 Papenfuss et al.
8,091,703 B2 1/2012 Marchetti et al.
8,123,030 B2 2/2012 Hein
8,276,750 B2 10/2012 Biondi et al.
8,308,363 B2 11/2012 Vogt et al.
8,418,845 B2 4/2013 Tawada et al.
8,474,612 B2 7/2013 Bertuzzi et al.
8,556,072 B2 10/2013 Bertuzzi et al.
8,590,701 B2 11/2013 Bertuzzi et al.
8,671,648 B2 3/2014 Bertuzzi et al.
8,783,454 B2 7/2014 Igo
8,827,145 B2 9/2014 Hultberg
9,033,141 B2 5/2015 Ghini et al.
9,089,165 B2 7/2015 Bertuzzi et al.
9,254,938 B2 2/2016 Iwata
9,359,124 B2 6/2016 Lutzig
9,382,062 B2 7/2016 Mitten et al.
9,499,331 B2 11/2016 Seyfferth De Oliveira
9,533,821 B2 1/2017 Buse
9,714,134 B2 7/2017 Tacchi
10,053,273 B2 8/2018 Petrucci et al.
10,450,120 B1 10/2019 Bellamah et al.
10,689,176 B2 6/2020 Bellamah et al.
11,414,251 B2 * 8/2022 Bellamah ..... B65D 65/14
2003/0037586 A1 2/2003 Durney et al.
2003/0047470 A1 3/2003 Parker
2005/0041889 A1 2/2005 Scarberry
2005/0130822 A1 6/2005 Rath
2005/0284776 A1 12/2005 Kobayashi et al.
2006/0011504 A1 1/2006 Gosebruch et al.
2006/0021883 A1 2/2006 Focke et al.
2006/0037876 A1 2/2006 Fath et al.
2006/0231431 A1 10/2006 Tambo
2008/0230410 A1 9/2008 Jones et al.
2009/0071852 A1 3/2009 Negrini
2009/0177717 A1 7/2009 Meehan et al.
2009/0184158 A1 7/2009 Lutzig et al.
2009/0308766 A1 12/2009 Polloni et al.
2010/0163563 A1 7/2010 Lutzig
2011/0114518 A1 5/2011 Hein
2011/0180432 A1 7/2011 Blick et al.
2012/0111746 A1 5/2012 Tanbo et al.
2012/0177307 A1 7/2012 Duan et al.
2012/0241339 A1 9/2012 Buse
2012/0291401 A1 11/2012 Mitten et al.
2013/0168440 A1 7/2013 Mills et al.
2013/0270268 A1 10/2013 Lyzenga et al.
2014/0079343 A1 3/2014 Lyzenga et al.
2014/0110286 A1 4/2014 Bertuzzi et al.
2014/0374290 A1 12/2014 Seyfferth DeOliveira
2015/0021219 A1 1/2015 Seyfferth DeOliveira
2015/0027916 A1 1/2015 Buse
2015/0034509 A1 2/2015 Seyfferth DeOliveira
2015/0041346 A1 2/2015 Seyfferth De Oliveira
2015/0320111 A1 11/2015 Slooff
2015/0375923 A1 12/2015 Pilzecker
2016/0145024 A1 5/2016 Pezzoli
2016/0236855 A1 8/2016 Chatelain et al.
2016/0368645 A1 12/2016 Buse
2017/0036835 A1 2/2017 Duncan
2017/0036849 A1 2/2017 Mitten et al.
2017/0073136 A1 3/2017 Konicke
2017/0152100 A1 6/2017 Polloni et al.
2017/0233158 A1 8/2017 Lyzenga et al.
2017/0334634 A1 11/2017 Bray et al.
2017/0341852 A1 11/2017 Bray et al.
2018/0105339 A1 4/2018 Bellamah et al.
2018/0111729 A1 4/2018 Koike
2018/0111739 A1 4/2018 Tritz et al.
2018/0118445 A1 5/2018 Hibbert
2018/0334316 A1 11/2018 Buse
2018/0339846 A1 11/2018 Eggen
2018/0354695 A1 12/2018 Bourgoin et al.
2018/0362247 A1 12/2018 Slooff
2019/0144197 A1 5/2019 Bourgoin et al.
2019/0218021 A1 7/2019 Buse
2019/0300273 A1 10/2019 Lutzig
2019/0329954 A1 * 10/2019 Blyth ..... B65D 77/2096
2019/0344946 A1 * 11/2019 Huffer ..... B65D 75/5855

FOREIGN PATENT DOCUMENTS

JP 3210242 U 5/2017
TW 200902181 A 1/2009
WO WO-2008142540 A1 11/2008
WO WO-2013120916 A1 8/2013
WO WO-2014195008 A2 12/2014
WO WO-2016059077 A1 4/2016
WO WO-2016087819 A1 6/2016
WO WO-2016102461 A1 6/2016
WO WO-2017002002 A1 1/2017
WO WO-2018024375 A1 2/2018
WO WO-2018059729 A1 4/2018

OTHER PUBLICATIONS

International Search Report and Written Opinion dated Apr. 23,

(56) References Cited

OTHER PUBLICATIONS 2018 in corresponding International Patent Application No. PCT/US2018/020127, (13 pages).
International Search Report and Written Opinion dated Feb. 14, 2018 in corresponding International Patent Application No. PCT/US2017/056272, 12 pages.
Third Party Observation dated Nov. 16, 2018 in corresponding International Patent Application No. PCT/US2018/020127, 4 pages.
Extended European Search Report dated Feb. 28, 2020 in corresponding European Patent Application No. 19208247.7, 8 pages.
Office Action for European Application No. 19 208 247.7 dated Feb. 25, 2021.

* cited by examiner

RE-SEAL LABEL AND CONTAINER WITH RE-SEAL LABEL

CROSS-REFERENCE TO RELATED APPLICATIONS

This application is a continuation patent application of U.S. patent application Ser. No. 16/875,044, filed May 15, 2020, which is a continuation patent application of U.S. patent application Ser. No. 16/568,734 filed Sep. 12, 2019, which is a continuation patent application of U.S. patent application Ser. No. 16/193,112, filed Nov. 16, 2018, the entire contents of each of which is incorporated herein by reference.

FIELD

The present disclosure relates to labels for packaging for consumer goods and/or packaging for consumer goods, including tobacco products such as a cigarette packs, other type of tobacco products or other type of products.

BACKGROUND

Various approaches have been made for packaging consumer goods. Known packages employ outer containers having a hinged lid providing access to an inner container with an opening for accessing consumer goods therein.

SUMMARY

Some example embodiments described herein are directed to a re-sealable label for covering an access opening of an inner box that fits within an outer box that includes a hinged lid. The re-sealable label includes a sheet of polymer material having a re-sealable adhesive on an underside thereof. A liner is adhered to the sheet of polymer material wherein the liner is configured to cover the access opening of the inner box when the hinged lid of the outer box is closed and uncover the access opening of the inner box when the hinged lid of the outer box is opened. A line of perforations in the sheet of polymer material form a fold line defining a connecting tab, and one or more of the perforations of the line of perforations include a rectilinear portion and a non-rectilinear portion.

In some example embodiments, a box in a box re-sealable container includes an outer box having a hinged lid and an inner box inside the outer box. The inner box includes an access opening which is accessible when the hinged lid of the outer box is opened. A re-sealable label includes a first zone of permanent adhesive at an upper portion of the re-sealable label on an underside of the re-sealable label, which attaches the re-sealable label at least to a back wall of the inner box. The re-sealable label includes a line of perforations defining a connecting tab at a lower portion of the re-sealable label wherein each of the perforations of the line of perforations includes a rectilinear portion and a non-rectilinear portion. The re-sealable label includes a second zone of permanent adhesive at an outer side of the connecting tab that attaches the connecting tab to an inner surface of the hinged lid of the outer box. The re-sealable label includes a zone of re-sealable adhesive on the underside of the re-sealable label that releasably attaches to a top wall and a front wall of the inner box such that a liner on the underside of the re-sealable label covers the access opening when the hinged lid is in a closed position and uncovers the access opening when the hinged lid is in an open position.

In some example embodiments, a re-sealable label for covering an opening of a box includes a sheet of polymer material having a re-sealable adhesive on an underside thereof and a liner adhered to the underside of the sheet of polymer material. The liner is configured to cover the opening and includes a foil layer and a paper layer. The re-sealable label includes a line of perforations in the sheet of polymer material wherein each of the perforations of the line of perforations includes a rectilinear portion and a non-rectilinear portion.

Some example embodiments described herein can include features described in U.S. patent application Ser. No. 15/292,913, U.S. patent application Ser. No. 15/420,862, U.S. patent application Ser. No. 15/616,450, U.S. patent application Ser. No. 15/446,789, U.S. patent application Ser. No. 15/668,822, and U.S. patent application Ser. No. 16/148,558, which are each hereby incorporated by reference herein in their entireties.

BRIEF DESCRIPTION OF THE DRAWING FIGURES

DETAILED DESCRIPTION

Reference will now be made in detail to the various embodiments, one or more examples of which are illustrated in each figure. Each example is provided by way of explanation and is not meant as a limitation. For example, features and/or method steps illustrated or described as part of one example embodiment and/or example method can be used on or in conjunction with other example embodiments and/or method steps to yield yet further example embodiments or methods. It is intended that the present disclosure includes such modifications and variations. In this specification, the word "about" is sometimes used in connection with numerical values to indicate that mathematical precision is not intended. Accordingly, where the word "about" is used with a numerical value, that numerical value should be interpreted to include a tolerance ±10% of the stated numerical value. In this specification, the word "or" is used inclusively.

Example embodiments are directed to a label that can be used for a container for consumer goods. In an example embodiment of a container, the container can have a rigid inner box located within a rigid outer box. The outer box has a hinged lid that opens and closes to allow access to the inner box. The inner box has an opening for accessing the consumer goods located therein. A re-sealable label is attached to the rigid inner box and to an inner surface of the hinged lid of the rigid outer box such that the opening is covered by the re-sealable label when the hinged lid is in a closed position. The inner box has an inner liner including at least a layer of paper or other suitable material as desired. According to an embodiment disclosed herein, at least a portion of the re-sealable label can have one or more layers where an innermost layer is composed of paper. Embodiments of a re-sealable label may be used for other types of containers, including containers with only one box as opposed to an inner box and an outer box, or containers with more than two boxes.

Figure 1:
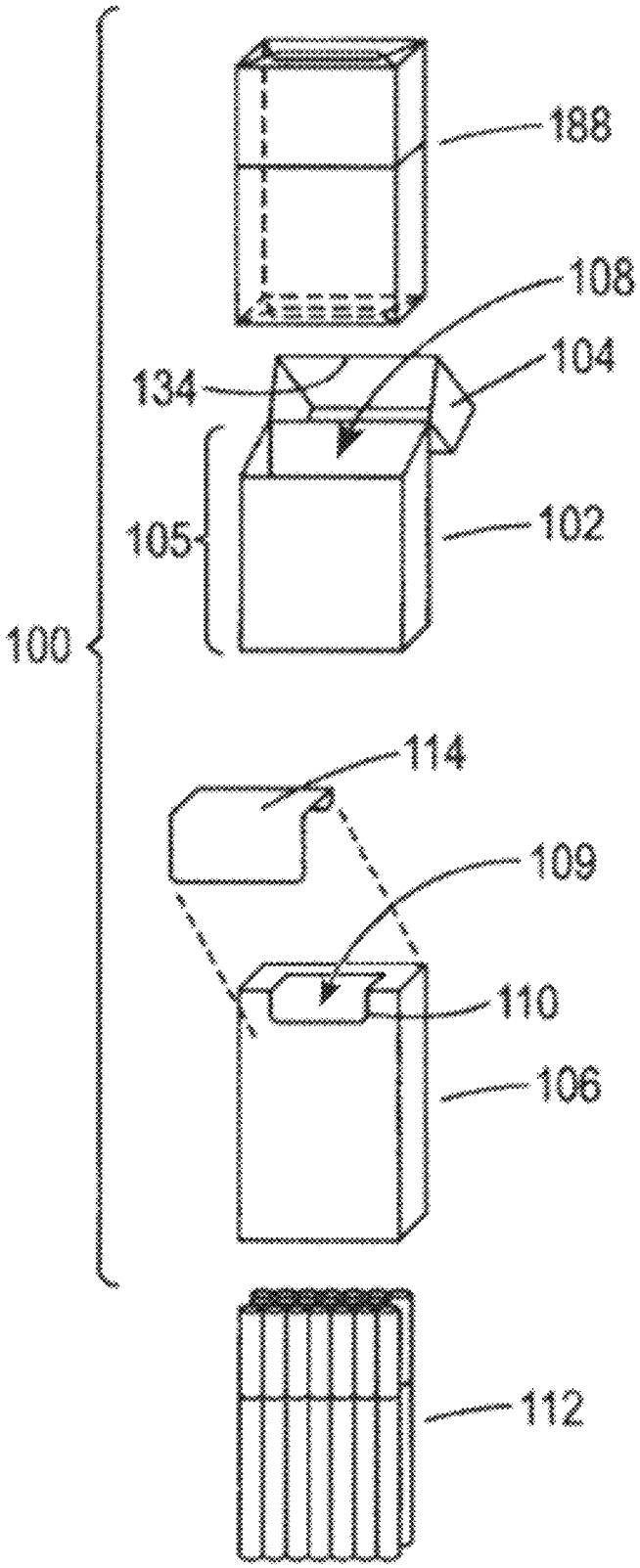
FIG. 1 illustrates an exploded view of a container for consumer goods in accordance with an example embodiment.

FIG. 1 illustrates a layout of a container 100 for consumer goods in accordance with an example embodiment. As shown in FIG. 1, container 100 includes a rigid outer box 102 having a body 105 and a hinged lid 104 configured to provide access to a rigid inner box 106 that is deposited within an inner volume 108 of the rigid outer box 102. The inner box 106 has an access opening 110 configured to provide access to consumer goods 112 stored or contained within an inner volume 109 thereof. The inner box 106 is of sufficient size to slidably and snugly fit within the inner volume 108 of the outer box 102. The inner box 106 can be securely held within the outer box 102 via contact friction between opposing surfaces of the inner box 106 and outer box 102 and/or with adhesives. A re-sealable label 114 is arranged to cover the access opening 110 of the inner box 106. When the container 100 is fully assembled, the outer box 102 can be wrapped with an outer film 188.

Figure 2:
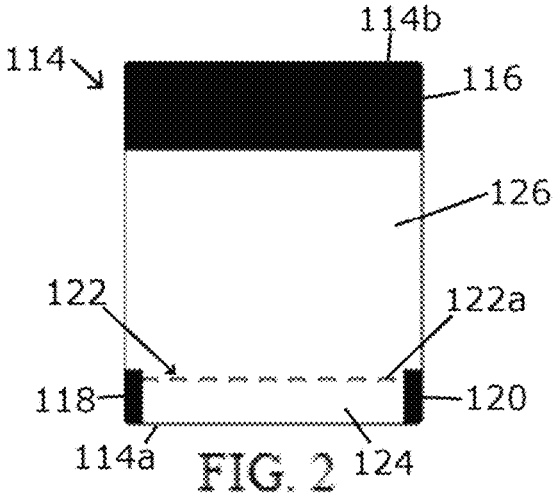
FIG. 2 illustrates a re-sealable label in accordance with an example embodiment.
Figure 3:
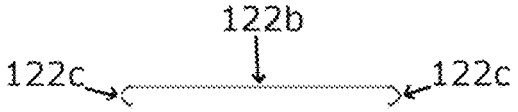
FIG. 3 illustrates a perforation of a fold line on a re-sealable label according to an example embodiment.

FIG. 2 illustrates an example embodiment of a re-sealable label 114 which includes a sheet 126 of material such as a polymer material or other suitable materials. The sheet 126 can include markings 116, 118, 120 (which in an example embodiment may be machine readable markings) and a fold line 122 (e.g., hinge line) defining a connecting tab 124 at one end of the re-sealable label 114. The fold line 122 is formed by a series of perforations 122*a*. In an example embodiment, the series of perforations 122*a* may minimize or reduce tearing of the re-sealable label 114 during opening of the hinged lid 104 as opposed to packaging with a label without said perforations 122*a*. Example embodiments include a fold line 122 formed from the series of perforations 122*a*. The perforations 122*a* can have rectilinear portions 122*b* with non-rectilinear portions 122*c* at a single end of the respective rectilinear portions 122*b*, or the perforations 122*a* can have rectilinear portions 122*b* with non-rectilinear portions 122*c* at both ends of the respective rectilinear portions 122*b*. In some example embodiments, the non-rectilinear portions 122*c* at one or both ends of the rectilinear portions 122*b* of the perforations 122*a* are configured to minimize or reduce tearing of the re-sealable label 114 by dissipating forces generated across the re-sealable label 114 when the re-sealable label 114 is unsealed and re-sealed. For example, as shown in FIG. 3, each perforation 122*a* can have a rectilinear portion 122*b* and arcuate non-rectilinear portions 122*c* at both ends of the rectilinear portion 122*b*. In an example embodiment, the arcuate non-rectilinear portions 122*c* can be half-circles. In some example embodiments, the half circles can dissipate forces across radii thereof so as to minimize tearing of the re-sealable label 114 when the re-sealable label 114 is unsealed and re-sealed.

Dimensions of an example embodiment of a re-sealable label can be as follows. The re-sealable label 114 can have a length of about 65 mm and a width of about 50 mm. A fold line 122 can extend across the width of the re-sealable label 114 and can be located about 7.5 mm from a first end 114*a* of the re-sealable label 114. The fold line 122 can include 9 perforations 122*a*. The perforations 122*a* can have lengths of about 2.7 mm with spaces of about 2.3 mm between adjacent perforations 122*a*. Each arcuate non-rectilinear portion 122*c* can have a radius of about 0.1 mm. The arcuate non-rectilinear portions 122*c* can extend towards the first end 114*a* of the re-sealable label 114. These dimensions are simply example dimensions of an example embodiment. Other dimensions may be used depending on the size of opening that a re-sealable label may cover, the box or boxes that the re-sealable label may be used with, and/or other uses that a re-sealable label may be used for.

Figure 4:
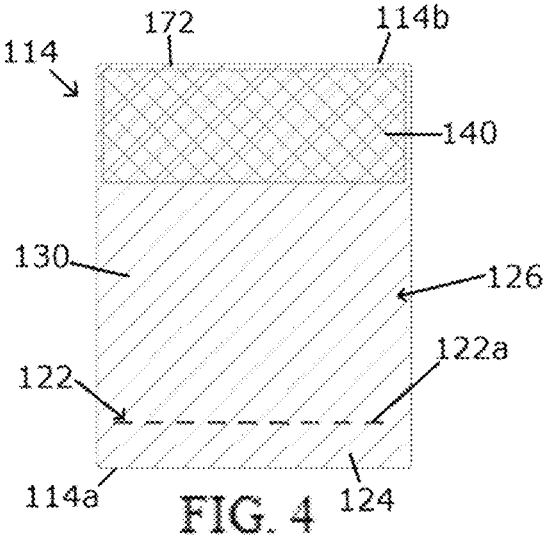
FIG. 4 illustrates an underside of a re-sealable label according to an example embodiment prior to application of a liner.

FIG. 4 illustrates an underside of a sheet 126 of a re-sealable label 114 according to an example embodiment prior to application of a paper liner. The re-sealable label 114 of the example embodiment can include a first zone of re-sealable adhesive 130 which covers, for example, about 50% or more of the underside of the re-sealable label 114. In an example embodiment, the first zone of re-sealable adhesive 130 is applied by flood coating and the first zone entirely covers the underside of the re-sealable label 114. The re-sealable label 114 can include a second zone of permanent adhesive 140 which covers, for example, about 1% to about 50% of the underside of the re-sealable label 114. In an example embodiment, the second zone of permanent adhesive 140 covers about 20% to 40% of the underside of the re-sealable label 114, or in another example the second zone of permanent adhesive 140 covers about 30% of the underside of the re-sealable label 114. Different proportions and percentages may be used in various embodiments and the examples provided herein are merely provided to explain certain examples. In an example embodiment, the second zone of permanent adhesive 140 is a rectangular area (which may have round corners) extending from a second end 114*b* of the re-sealable label 114 toward the first end 114*a*. In an example embodiment, the rectangular second zone of permanent adhesive 140 can be separated from the second end 114*b* of the re-sealable label 114 by a border 172 between the second end 114*b* and the second zone of permanent adhesive 140 that does not include permanent adhesive. The border 172 that does not include permanent adhesive can also or alternatively extend along a first side edge, a second side edge, or both the first and second side edges of the re-sealable label 114 so as to separate the second zone of permanent adhesive 140 from the first side edge, the second side edge, or both the first and second side edges (for example, in the example shown in FIG. 4, a border 172 that does not include permanent adhesive separates the second zone of permanent adhesive 140 from the second end 114*b* of the re-sealable label 114, from the first side edge of the re-sealable label 114, and from the second side edge of the re-sealable label 114). In an example embodiment, a border 172 that does not include permanent adhesive separates the second end 114*b*, the first side edge, and the second side edge of the re-sealable label 114 from the perimeter of the rectangular second zone of permanent adhesive 140 by a distance of about 1 mm. In an example embodiment, the first zone of re-sealable adhesive 130 and the second zone of permanent adhesive 140 can be created by applying re-sealable adhesive to the entire underside of a label 114, and applying permanent adhesive over a portion of the re-sealable adhesive, thereby creating a first zone of re-sealable adhesive 130 (the portion that does not have permanent adhesive over it), and a second zone of permanent adhesive 140 (the portion that has permanent adhesive over it). This, for example, can be appreciated in the example shown in FIG. 4, where slanted lines denote re-sealable adhesive, and permanent adhesive is shown applied over the slanted lines in zone 140 thereby creating second zone of permanent adhesive 140. In another example embodiment, the first zone of re-sealable adhesive 130 and the second zone of permanent adhesive 140 can be created by applying re-sealable adhesive to a first portion of the underside of a label 114, and applying permanent adhesive to a second portion of the underside of the label 114 (in an example embodiment, the second portion could be a remaining portion of the underside of the label), the first portion being the first zone of re-sealable adhesive 130 and the second portion being the second zone of permanent adhesive 140.

Figure 5:
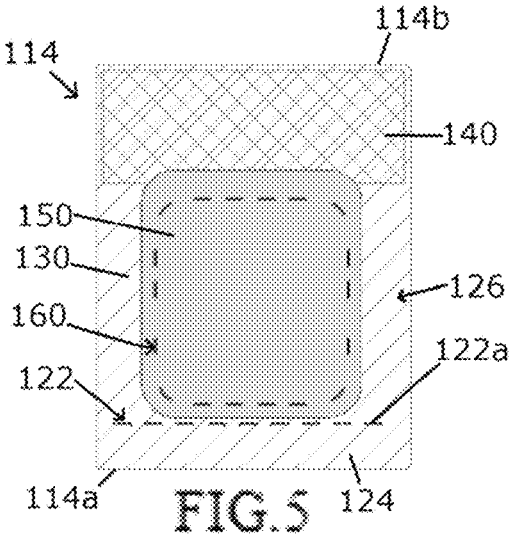
FIG. 5 illustrates the re-sealable label shown in FIG. 4 after application of a liner according to an example embodiment.

FIG. 5 illustrates the re-sealable label 114 shown in FIG. 4 after application of a liner 150 according to an example embodiment. In an example embodiment, the liner 150 includes a paper layer, and a foil layer, and the foil layer side is adhered to the re-sealable label 114. In an example embodiment, the liner 150 further includes a layer of adhesive between the paper layer and the foil layer. In an example embodiment the layer of adhesive includes silicate adhesive, but other adhesives may be used. In example embodiment, the paper layer of the liner 150 includes paper such as 19 pound paper, but other types of paper may be used. The paper layer is configured to face consumer goods 112 when label 114 is used to cover an access opening 110 for a container 100 with consumer goods 112 such as that shown in FIG. 1. In the example shown in FIG. 6, the dotted line 160 illustrates the location of an access opening 110 when the re-sealable label 114 is applied to an inner box 106 of an example embodiment. In an example embodiment, the liner 150 can be a rectangular shaped sheet (which may include rounded corners) with a width of about 34 mm and a length of about 39 mm. Other dimensions may be used for liner 150 depending on the size of the re-sealable label 114 on which the liner 150 is used, and/or the size of an opening 110 that a liner 150 may be used to cover.

Figure 6:
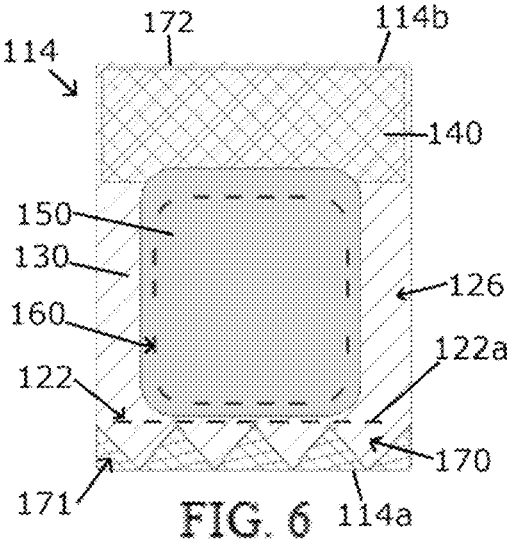
FIG. 6 illustrates a pattern of deadener on the re-sealable label shown in FIG. 5 according to an example embodiment.

FIG. 6 illustrates a pattern of deadener 171 on the re-sealable label 114 shown in FIG. 5 according to an example embodiment. In an example embodiment, the first zone of re-sealable adhesive 130 can be shaped to form a sawtooth pattern 170 by applying a pattern of adhesive deadener 171 on top of a portion of the re-sealable adhesive. In one example embodiment, the pattern of deadener 171 can include triangular portions of deadener. In an example embodiment, the re-sealable adhesive can be deadened by application of deadener at least on a portion of the re-sealable adhesive located between the fold line 122 and the first end 114*a* of the re-sealable label 114. The deadener 171 can be applied in a pattern including triangular portions such that a sawtooth pattern 170 of re-sealable adhesive 130 is formed. In an example embodiment, the deadener 171 is applied in a pattern such that the deadened area on the connecting tab 124 increases toward the first end 114*a*.

Figure 7:
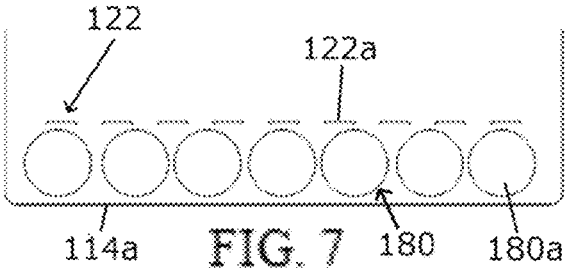
FIG. 7 illustrates a pattern of permanent adhesive applied to an outer side of a re-sealable label shown according to an example embodiment.

FIG. 7 illustrates a permanent adhesive 180 applied to an outer side of a re-sealable label 114 according to an example embodiment (the outer side of a re-sealable label is the side opposite the underside of the re-sealable label). In an example embodiment, the permanent adhesive 180 can be a series of glue dots 180*a* located on an outer side of a connecting tab 124 of a re-sealable label 114. In an example embodiment, the permanent adhesive 180 is configured to adhere a portion of the outer side of a re-sealable label 114 to an inner surface 134 of a hinged lid 104 (as shown, for example, in the examples of FIGS. 1 and 8). In an example embodiment, the permanent adhesive 180 is configured to adhere the outer side of a connecting tab 124 of a re-sealable label 114 to an inner surface 134 of a hinged lid 104.

Figure 8:
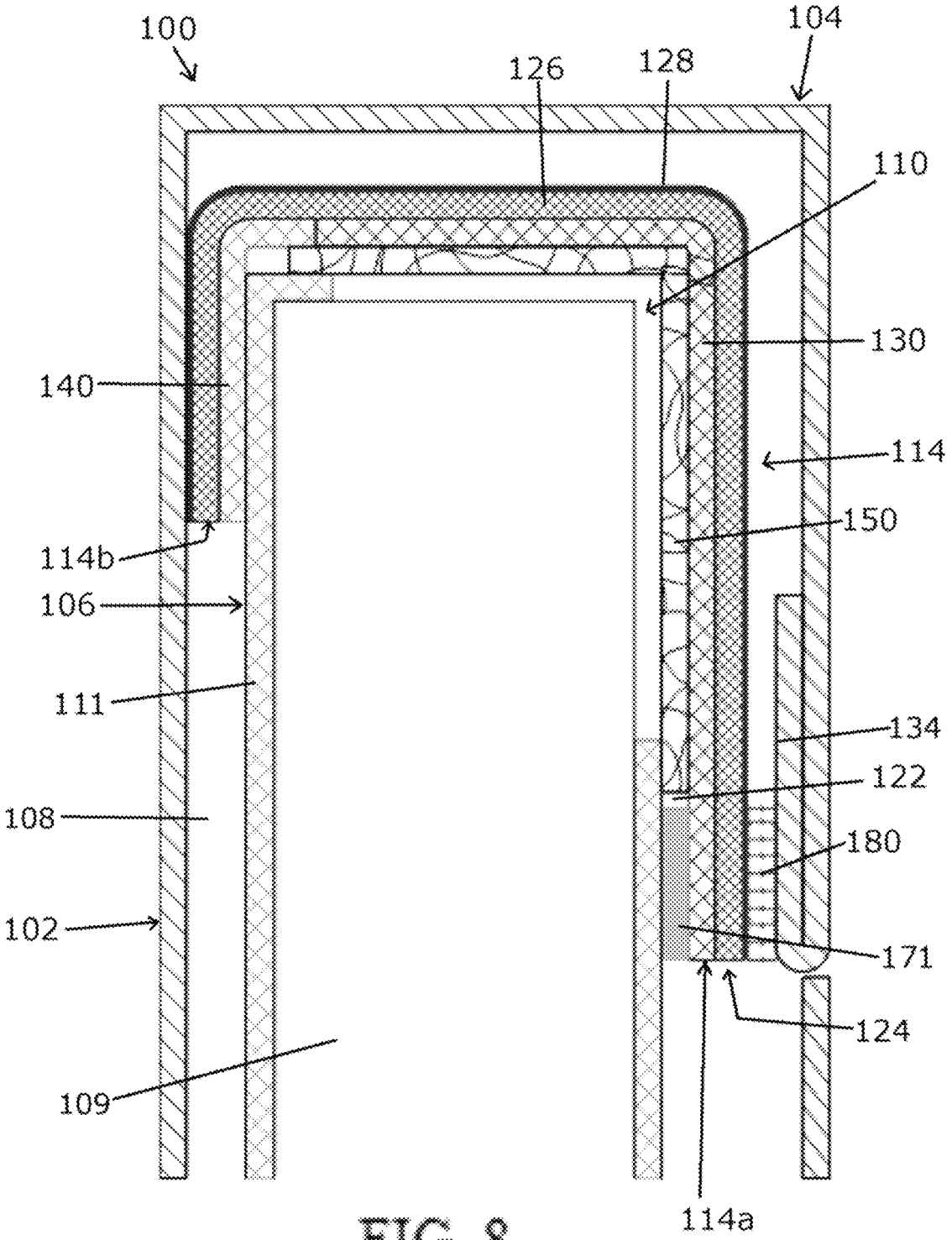
FIG. 8 illustrates a cross section of a box in box container with a re-sealable label according to an example embodiment.

FIG. 8 illustrates a cross section of a box in box container 100 with a re-sealable label 114 according to an example embodiment. The rigid inner box 106 has an inner volume 109 for consumer goods and is located within an inner volume 108 of the rigid outer box 102. The rigid outer box 102 has a hinged lid 104. The inner box 106 can include an inner paper layer, an outer paperboard layer, and a foil layer therebetween, the inner paper layer configured to be in contact with consumer goods stored therein. The outer box 102 can be made of a sheet of paperboard having panels folded and adhered to form the hinged lid 104. The re-sealable label 114 can include a rectangular shaped polymer sheet 126 (which may include rounded corners). The polymer material can include polyethylene, polyethylene terephthalate (PET), and/or other suitable materials. The re-sealable label 114 can also include in an example embodiment an outer layer 128 of ink to provide desired graphics, text and/or markings such as markings 116, 118, 120 of the example in FIG. 1. In the example embodiment shown in FIG. 8, a second zone of permanent adhesive 140 attaches an underside of the re-sealable label 114 to a back panel 111 of the inner box 106. In an example embodiment, the second zone of permanent adhesive 140 can also contact and/or attach to a rear portion of a top panel of the inner box 106 (while a gap is shown in FIG. 8 between the second zone of permanent adhesive 140 and the portion of the top panel of the inner box 106 that does not have liner 150 over it, the drawing is not to scale, including the thickness of liner 150, and in some example embodiments the second zone of permanent adhesive 140 can contact and/or attach to said portion of said top panel of the inner box 106). In an example embodiment, a pattern of permanent adhesive 180 on the outer surface of a connecting tab 124 attaches an outer surface of the connecting tab 124 to an inner surface 134 of the hinged lid 104 such that the access opening 110 of the inner box 102 may be unsealed and re-sealed by the re-sealable label 114 via movement of the hinged lid 104 of the outer box 102.

According to an example embodiment, liner 150 is configured to cover access opening 110 of inner box 106 such that an outer periphery of the liner 150 extends past the periphery of the access opening 110 when the hinged lid 104 of the outer box 102 is in a closed position (see, e.g., FIG. 5). The re-sealable label 114 of an example embodiment includes an exposed layer of re-sealable adhesive 130 that surrounds a portion or the entire access opening 110 of the inner box 106 outward of the periphery of the liner 150 (see, e.g., FIG. 5). In the example embodiment shown in FIG. 5, the exposed layer of re-sealable adhesive 130 of the re-sealable label 114 extends along three edges of the liner 150 while the second zone of permanent adhesive 140 overlies the re-sealable adhesive along the fourth edge of the liner 105. In an example embodiment, the sawtooth pattern 170 of re-sealable adhesive 130 (see, e.g., FIG. 6) having the deadener 171 promotes peeling of a re-sealable label 114 away from surfaces of the inner box 106 when the hinged lid 104 box 102 is opened to unseal the access opening 110 and/or rolling of the re-sealable label 114 over surfaces of the inner box 106 when the hinged lid 104 is closed to re-seal the access opening 110. The deadener 171 overlies portions of the re-sealable adhesive 130 of an example embodiment to render those deadener coated portions non-adhesive, forming pattern 170 of re-sealable adhesive 130 on the connecting tab 124. In an example embodiment, the pattern 170 of re-sealable adhesive 130 on the connecting tab 124 includes the deadener 171 coated thereon, and may be configured to facilitate peeling of the pattern 170 of re-sealable adhesive 130 away from the inner box 106 when the hinged lid 104 is opened.

In an example embodiment, a re-sealable label 114 can be used with a container 100 that includes an outer box 102 having the size of a traditional cigarette pack, or having a slightly larger size than a traditional cigarette pack to accommodate an inner box 106. The size of the container 100, including an outer box 102 and inner box 106 will depend on the size of the consumer goods 112.

According to an example embodiment, an outer box 102 can include paperboard with one or more optional coatings thereon. For example, the outer box 102 can include paperboard which has been embossed with a design, lettering, pattern, and/or symbol as desired and/or coated with an ink, varnish, metallization, or other suitable material for product identification. When a container 100 is fully assembled, outer box 102 can be wrapped with an outer film 188 (see FIG. 1) such as a polypropylene film with or without a tear tape that allows for tearing open outer film 188. According to an example embodiment, an inner box 106 can include a paperboard layer and an inner paper layer configured to be in contact with consumer goods that may be stored therein. A foil layer can be between the paperboard layer and the inner paper layer. Other materials may be used for an outer box and for an inner box.

In an example embodiment, a re-sealable label 114 can be used with an inner box 106 that includes a back wall, a bottom wall, a top wall, side walls, and/or a front wall, and a part of the top wall and a part of the front wall include access opening 110 (as shown, for example, in FIG. 1). In an example embodiment, re-sealable label 114 can be configured to cover opening 110, with re-sealable adhesive 130 configured to adhere to left and right portions of the top wall, and to left and right portions of the front wall. In an example embodiment, the left and right portions include portions that are to the left and right of the opening 110. In an example embodiment, the front wall may include a bottom front panel and a top front panel, and part of the top wall and part of the top front panel include access opening 110. In an example embodiment, re-sealable label 114 can be configured to cover opening 110, with re-sealable adhesive 130 configured to adhere to left and right portions of the top wall, and to left and right portions of the top front panel. In an example embodiment, the left and right portions include portions that are to the left and right of the opening 110.

In an example embodiment, a re-sealable label 114 can be used with an outer box 102 that includes a body 105 that can include a back wall, a bottom wall, a front wall, and/or side walls, and the outer box 102 can further include a hinged lid 104 that can include a top wall, a front wall, a back wall and/or side walls, and where a connecting tab 124 of the re-sealable label can be attached to an inner surface of the hinged lid 104. In an example embodiment, a connecting tab 124 of the re-sealable label can be attached to an inner surface of the front wall of the hinged lid 104.

In an example embodiment, a container 100 includes a rigid inner box 106 within a rigid outer box 102. Outer box 102 includes a hinged lid 104 for accessing the inner box 106 and the inner box 106 includes an access opening 110 for accessing consumer goods that may be located therein. The container 100 also includes a re-sealable label 114 affixed to an inner surface 134 of the hinged lid 104 of the outer box 102 via a permanent adhesive 180. When the hinged lid 104 is closed, the re-sealable label 114 is affixed to the inner box 106 via areas of permanent and re-sealable adhesives, and a liner 150 of the re-sealable label 114 covers the access opening 110 of the inner box 106. When the hinged lid 104 is open, the re-sealable label 114 is affixed to the inner box 106 via at least the area of permanent adhesive. In further example embodiments, re-sealable label 114 is configured to re-sealably adhere to a surface of the inner box 106 at least partially surrounding the access opening 110 outward of the periphery of liner 150 via the re-sealable adhesive 130.

Embodiments of a re-sealable label 114 are not limited for uses with containers 100, outer boxes 102 and/or inner boxes 106. Embodiments of a re-sealable label 114 may be used for applications other than with such containers and boxes.

Thus, it will be appreciated by those skilled in the art that the present invention can be embodied in other specific forms without departing from the spirit or essential characteristics thereof. The presently disclosed embodiments are therefore considered in all respects to be illustrative and not limiting. The scope of the invention is indicated by the appended claims rather than the foregoing description and all changes that come within the meaning and range and equivalence thereof are intended to be embraced therein.

What is claimed is:

1. A re-sealable label for covering an opening of a box, the re-sealable label comprising:
   - a polymer material sheet having a first side, a second side, a first end, and a second end, the second side being parallel to the first side, and the first end opposing the second end;
   - a first zone on the first side of the polymer material sheet, the first zone including a re-sealable adhesive, the first zone covering greater than or equal to 50% of a total surface area of the first side of the polymer material sheet;
   - a second zone on the first side of the polymer material sheet, the second zone including a permanent adhesive, the second zone covering greater than or equal to 1% to less than or equal to 50% of the total surface area of the first side of the polymer material sheet, the second zone at least partially overlapping the first zone;
   - a border separating the second zone and the first end; and
   - a line of perforations extending across a width of the polymer material sheet near the second end.

2. The re-sealable label of claim 1, wherein a distance between the second zone and the first end is 1 mm.

3. The re-sealable label of claim 1, wherein the first zone covers an entire surface area of the first side of the polymer material sheet.

4. The re-sealable label of claim 1, wherein the second zone covers greater than or equal to 20% to less than or equal to 40% of the total surface area of the first side of the polymer material sheet.

5. The re-sealable label of claim 1, wherein the second zone is a rectangular area.

6. The re-sealable label of claim 4, wherein the rectangular area has rounded corners.

7. The re-sealable label of claim 1, wherein the second zone includes a series of glue dots.

8. The re-sealable label of claim 1, wherein each of the perforations in the line of perforations include a rectilinear portion and a non-rectilinear portion, the non-rectilinear portion extending away from the rectilinear portion in a direction away from the first end.

9. The re-sealable label of claim 1, wherein the re-sealable label further comprises a liner over at least a portion of the first zone and at least a portion of the second zone.

10. The re-sealable label of claim 9, wherein the liner includes a paper layer and a foil layer, the foil layer facing the first side of the paper material sheet.

11. The re-sealable label of claim 9, wherein the liner has a rectangular shape.

12. The re-sealable label of claim 11, wherein the rectangular shape has rounded corners.

13. The re-sealable label of claim 11, wherein the rectangular shape has a width of 24 mm and a length of 39 mm.

14. The re-sealable label of claim 1, wherein the re-sealable label further comprises a third zone at the second end of the first side of the polymer material sheet, the third zone including an adhesive deadener.

15. The re-sealable label of claim 14, wherein the adhesive deadener is arranged in a triangular pattern so as to define the third zone.

16. The re-sealable label of claim 15, wherein the triangular pattern is a sawtooth pattern.

17. The re-sealable label of claim 14, wherein the third zone overlaps the first zone.

18. The re-sealable label of claim 1, wherein the re-sealable label has a length of 65 mm and a width of 50 mm.

19. The re-sealable label of claim 1, wherein the line of perforations includes nine perforations that are 7.5 mm from the second end.

20. The re-sealable label of claim 1, wherein the second side includes graphics, texts, markings, or any combination thereof.

* * * * *